United States Patent [19]

Beach

[11] 4,433,754

[45] Feb. 28, 1984

[54] STEPLADDER STABILIZER ASSEMBLY

[76] Inventor: John Beach, 435 E. 157th Pl., South Holland, Ill. 60473

[21] Appl. No.: 320,856

[22] Filed: Nov. 13, 1981

[51] Int. Cl.[3] ..... E06C 1/20

[52] U.S. Cl. ..... 182/172

[58] Field of Search ..... 182/172, 107, 108, 129

[56] References Cited

U.S. PATENT DOCUMENTS

| | | | |
|---|---|---|---|
| 1,676,618 | 7/1928 | Morris | 182/172 |
| 2,868,427 | 1/1959 | Hess | 182/108 |
| 3,042,142 | 7/1962 | Butler | 182/129 |
| 3,618,703 | 11/1971 | Wilke | 182/107 |
| 3,891,054 | 6/1975 | Larson | 182/107 |
| 3,901,354 | 8/1975 | Grebausky | 182/172 |
| 4,011,926 | 3/1977 | Larson | 182/107 |
| 4,147,231 | 4/1979 | Chantler | 182/172 |
| 4,175,641 | 11/1979 | Reyes | 182/172 |
| 4,244,446 | 1/1981 | Mair | 182/172 |

*Primary Examiner*—R. P. Machado

*Attorney, Agent, or Firm*—Sabin C. Bronson

[57] ABSTRACT

An improved stabilizer assembly for use with stepladders comprises a board member capable of being secured to the top platform of the stepladder; first and second hinges associated with the board member at or near opposing lateral ends of the board member; and first and second support legs associated with first and second hinges, respectively, and being capable of extending from the secured board member to improve the stability of the ladder.

6 Claims, 4 Drawing Figures

STEPLADDER STABILIZER ASSEMBLY

This invention relates to a stabilizer assembly for use with stepladders. More particularly, this invention relates to an integrated or unitary assembly which provides improved support for users of stepladders.

Stepladders have very many useful applications. However, the safety of the individual using the stepladder is an important consideration. Various systems have been suggested as aids to improve the safety of stepladders. Representative systems are those disclosed in the following U.S. Pat. Nos.: 1,676,618; 2,868,427; 3,618,703; 3,891,054; 3,901,354; 4,011,926; 4,147,231; 4,175,641; and 4,244,446.

Systems with but one support leg, e.g., such as that suggested in U.S. Pat. No. 3,901,354, may not provide sufficient stability. For example, the stepladder user may lean in the direction away from the single support leg and cause destabilization of the ladder and injury to himself. On the other hand, systems with two support legs, e.g., see U.S. Pat. No. 4,175,641, are often permanently affixed to the rails of a given stepladder and thus, become a permanent part of a single stepladder. It is relatively expensive for each stepladder to have its own system.

Therefore, one object of the present invention is to provide an improved stabilizer assembly for use with stepladders.

Another object of the present invention is to provide an improved stabilizer assembly which is adaptable for use with different stepladders. Other objects and advantages of the present invention will become apparent hereinafter.

An improved stabilizer assembly for use with a stepladder having a top end platform associated with spaced apart side rails has now been discovered. In one embodiment, the present system includes a rectangular board means having parallel sides and ends:

The board means is removably secured to the top platform of the stepladder in such a manner that the ends of the board means extend laterally beyond the ends respectively of the top of the stepladder. A hinge means is secured to the bottom of the ends of the board means which extend beyond the ends of the stepladder top. First and second elongated support means are associated with the first and second hinge means respectively, and extend from the board means (when it is secured to the top end platform) to improve the stability of the stepladder.

The present assembly includes two elongated support means for improved stability and safety. Yet, a single board means is provided, thus, reducing the number of parts in the assembly and making the assembly easier to install. Also, since in a preferred embodiment the board means is removably secured to the top platform, such removable assembly need not be used solely with one stepladder, but may be used, in turn, with many stepladders, as desired. In short, the present system provides improved stability, has relatively few parts, is easy to install and use and, preferably, a single system has the added flexibility of being easily used in conjunction with a number of different stepladders, as desired.

Preferably, the lengths of the first and second elongated support means are adjustable. This feature enhances the flexibility of the present assembly for use with different stepladders. These support means preferably are each of sufficient length, preferably adjustable length, so as to be capable of extending from the first and second hinge means, respectively, to the surface on which the stepladder used with the assembly is situated. In a still further embodiment, the first and second elongated support means include first and second flattened pad means, respectively, which are capable of contacting the surface on which the stepladder used with the present assembly is situated to further improve the stability of the stepladder.

The first and second elongated support means are preferably pivotally movable relative to the first and second hinge means, respectively. This feature again adds to the flexibility of the present assembly. For example, the first and second elongated support means can be independently placed to extend the desired distance laterally from the stepladder to provide the desired degree of stability. Since the lengths of the first and second elongated support means are preferably independently adjustable and are each capable of independent pivotal movement, the present assembly may be used with a stepladder situated (for use) on a surface which is not level.

Another preferred embodiment of the present assembly involves the relative positioning of the board means and the first and second hinge means. In this embodiment, the board means and hinge means are situated so that the board means acts to restrict the pivotal movement of the first and second elongated support means relative to the first and second hinge means respectively. In the event that, in use, the stepladder begins to fall toward one of the elongated support means, the board means, by restricting the pivotal movement of the elongated support means may stop the fall of the stepladder and allow the stepladder user to descend safely.

These and other aspects and advantages of the present invention are set forth in the following detailed description and claims, particularly when considered in conjunction with the accompanying drawings in which like parts bear like reference numerals.

DESCRIPTION OF THE PREFERRED EMBODIMENT

Figures 1, 2, 3, 4:
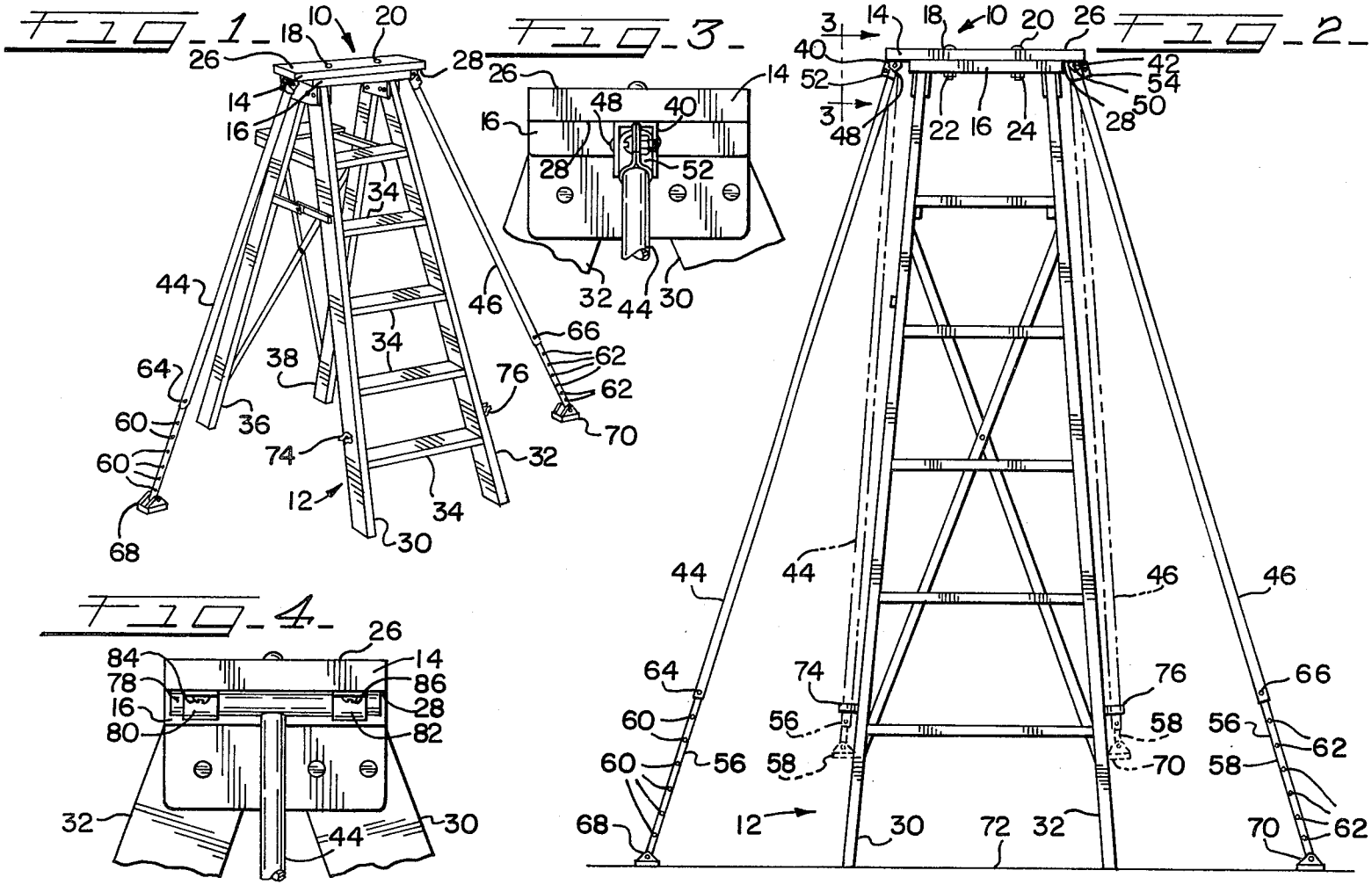
FIG. 1 is a front side perspective view of one embodiment of the present assembly as it would appear in use.
FIG. 2 is a front plan view of the embodiment shown in FIG. 1.
FIG. 3 is a plan view taken along lines 3—3 of FIG. 2.
FIG. 4 is a plan view of an alternate embodiment of the hinge sub-assembly useful in the present assembly.

Referring now to the drawings, the support assembly, shown generally at 10, is shown associated with a stepladder 12. Support assembly 10 includes a rectangular board 14 which is longer than and removably secured to top platform 16 of stepladder 12 by bolts 18 and 20, and nuts 22 and 24. As can be seen in the drawings, board 14 extends laterally beyond both side ends of top platform 16.

Stepladder 12 includes two pair of spaced apart side rails. Side rails 30 and 32 carry rungs (or steps) 34, while rails 36 and 38 provide added support to stepladder 12.

First and second hinges 40 and 42 are secured to bottom surface 28 of board 14. Support legs 44 and 46 are secured and pivotally movable relative to hinges 40 and 42 by pivot pins 48 and 50, respectively. Support legs 44 and 48 include collars 52 and 54, respectively, which are also secured and pivotally movable relative to hinges 40 and 42. Collars 52 and 54 are structured so that as legs 44 and 46, respectively, are moved (pivotally relatively to hinges 40 and 42) laterally away from stepladder 12, such movement is restricted by collars 52 and 54 contacting board 14. This feature adds improved strength, support and safety to assembly 10.

Support legs 44 and 46 also include tubular portions 56 and 58 which are in telescopic relation to support legs 44 and 46. Tubular portions 56 and 58 include a series of through holes 60 and 62. At the bottom of each support leg 44 and 46 is a through hole through which pins 64 and 66 extend. By moving tubular portions 56 and 58 in or out of telescopic relation with support legs 44 and 46, respectively, the length of each support leg tubular portion combination can be adjusted as desired. Once the desired length is obtained, pins 64 and 66 are passed through the hole at the bottom of support legs 44 and 46, and one of the holes 60 and 62, respectively, to, in effect, lock the support leg tubular portion combinations at the desired length. The structure described above does allow such lengths to be adjusted, as desired.

Pads 68 and 70 are affixed to the bottom of tubular portions 56 and 58, respectively. Pads 68 and 70 have a wide bottom surface area (relative to the cross section of the tubular portions) which contacts the surface 72 on which stepladder 12 is situated during use.

The shadow lines in FIG. 2 indicate a convenient means of storing assembly 10 and stepladder 12. Clamps 74 and 76 are secured to side rails 30 and 32, respectively. For storage, the lengths of the support leg tubular portion combinations are reduced (preferably to the minimum length) and locked in place as noted above. Support legs 44 and 46 are pivotally moved in toward stepladder 12 and come into engaging relation with clamps 74 and 76, respectively.

An alternate embodiment of a hinge sub-assembly is shown in FIG. 4. In this embodiment, support leg 44 terminates in a cross bar 78. Hinge clamps 80 and 82 are secured to bottom surface 28 of board 14 by screws 84 and 86. Cross bar 78 is free for limited rotation relative to hinge clamps 80 and 82, and such rotation causes support leg 44 to be pivotally movable relative to hinge clamps 84 and 88.

Support assembly 10 functions as follows. Two properly sized and spaced holes are made in top platform 16 of stepladder 12. Board 14 is secured in place on top platform 16 by bolts 18 and 20 and nuts 22 and 24, as noted above. Stepladder 12 is situated at the place on surface 72 where it is to be used. The lengths of the support leg tubular portion combinations are adjusted as desired and as noted above. Support legs 44 and 46 are moved pivotally away from stepladder 12 so that pads 68 and 70 come into contact with surface 72. At this point, assembly 10 is functional and the stepladder user may use stepladder, as desired.

After use, assembly 10 may be stored on stepladder 12 as described above. Alternately, assembly 10 may be easily removed from stepladder 12 and stored by itself or used on an entirely different stepladder.

While this invention has been described with respect to various specific embodiments and examples, it is to be understood that the invention is not limited thereto and that it can be variously practiced within the scope of the following claims.

The embodiments of the invention in which an exclusive property or privilege is claimed are defined as follows:

1. A stabilizer assembly for use with a stepladder having a top end platform associated with spaced apart side rails, said top end platform having a lateral dimension and first and second lateral ends, said assembly comprising a single board having a top and a bottom surface, and substantially opposing first and second side ends, said board being removably secured by a plurality of fastening means to said top end platform in such a manner that said first side end extends laterally at least to said first lateral end of said top end platform and said second side end extends laterally at least to said second lateral end of said top end platform; first and second hinge means associated with said bottom surface of said board at or near said first and second side ends of said board, respectively; and first and second elongated support means associated with said first and second hinge means, respectively, and extending from said secured single board to improve the stability of said stepladder, and said first and second hinge means are situated relative to said board such that said boards means further acts to restrict said pivotal movement of said first and second elongated support means, respectively.

2. The assembly of claim 1 wherein said board means is capable of being removably secured to said top end platform.

3. The assembly of claim 1 wherein the lengths of said first and second elongated support means are adjustable.

4. The assembly of claim 1 wherein said first and second elongated support means each is capable of extending from said first and second hinge means, respectively, to the surface on which said stepladder is situated.

5. The assembly of claim 4 wherein said first and second elongated support means include first and second flattened pad means respectively, which are contacting said surface to further improve the stability of said stepladder.

6. The assembly of claim 1 wherein said first and second elongated support means are pivotally movable relative to said first and second hinge means respectively.

* * * * *